US008800828B2

(12) United States Patent
Craig

(10) Patent No.: US 8,800,828 B2
(45) Date of Patent: Aug. 12, 2014

(54) BASEBALL GLOVE MOLD METHOD AND SYSTEM

(71) Applicant: Beau James Craig, Santee, CA (US)

(72) Inventor: Beau James Craig, Santee, CA (US)

( * ) Notice: Subject to any disclaimer, the term of this patent is extended or adjusted under 35 U.S.C. 154(b) by 0 days.

(21) Appl. No.: 13/691,151

(22) Filed: Nov. 30, 2012

(65) Prior Publication Data

US 2014/0151410 A1 Jun. 5, 2014

(51) Int. Cl.
*A41D 1/00* (2006.01)

(52) U.S. Cl.
USPC ..... 223/78

(58) Field of Classification Search
USPC ..... 223/78–80, 66
See application file for complete search history.

(56) References Cited

U.S. PATENT DOCUMENTS 4,418,849 A * 12/1983 Santa ..... 223/78
4,637,610 A * 1/1987 Carr ..... 473/458
4,765,519 A * 8/1988 Groves ..... 223/78
4,877,162 A * 10/1989 McGinley ..... 223/78
4,883,170 A * 11/1989 Wright ..... 223/78
4,958,729 A * 9/1990 Wright ..... 223/78
5,000,317 A * 3/1991 Cich ..... 223/78
5,267,677 A * 12/1993 Nash ..... 223/78
5,456,390 A * 10/1995 McFarland ..... 223/78
5,758,805 A * 6/1998 Dunn ..... 223/78
5,810,215 A * 9/1998 Plymell ..... 223/78
5,868,368 A * 2/1999 MacDonald ..... 248/176.3
6,430,746 B1 * 8/2002 Watson ..... 2/19

* cited by examiner

*Primary Examiner* — Nathan Durham

(57) ABSTRACT

A method of forming a mold for use with a baseball or softball glove comprising covering a substantial portion of the inner surface of the glove with a thin sheet of flexible material, applying a forming material to the flexible material such that the flexible material generally conforms to the shape of the inner surface of the glove, removing the hardened forming material from the glove, and removing the flexible material from the glove. The hardened forming material can be a mold for the glove, or can be used as a form to manufacture glove molds. The glove mold can be placed in the glove when it is not in use and secured in position by a strap or other suitable mechanism.

4 Claims, 4 Drawing Sheets

BASEBALL GLOVE MOLD METHOD AND SYSTEM

BACKGROUND OF THE INVENTION

1. Field of the Invention

The invention relates generally to the field of sporting goods. In particular, the invention relates to a method and system for molding and maintaining the shape of a baseball glove.

2. Description of Related Art

Baseball and softball gloves are typically made of leather and have evolved into different sizes and shapes that are suitable for different positions on the field. In use, the primary function of the glove is to securely catch a baseball or softball struck by a bat or thrown by another player on the field. In situations where the ball must be quickly transferred from the receiving player to another, such as when a fielder catches the ball and must throw it to a another player at a base, it is equally important that the glove allow for a quick and sure transfer of the ball to the throwing hand of the receiving player. These distinct, and somewhat inconsistent, requirements are best served by a glove with a "funnel" shape that naturally guides the ball into a well defined "pocket" area where it can be secured, and an open slot that does not interfere with the fielder's throwing hand when accessing the ball in the glove.

New baseball and softball gloves are typically highly structured and relatively stiff, and something of an art has developed for "breaking-in" new gloves. Common techniques involve soaking the glove in water, inserting one or more baseballs or softballs into the pocket area of the glove, then wrapping the glove with rubber bands or a similar device to provide compression while the leather dries. Other common techniques use various types of oils and leather conditioners to achieve a structured yet supple feel.

Once properly broken-in, however, baseball and softball gloves commonly lose their structure relatively quickly. Gloves are often kept in a bag with other equipment including bats and helmets, where they can be twisted and compressed so that they lose their shape. Since they are quite expensive and the breaking-in process is time consuming, players often keep using a glove after it has lost its optimal shape and structure. The present invention overcomes these problems, providing a method and system for maintaining the optimal shape and structure of a baseball glove over the life of the glove.

The prior art, including the use of simple round objects placed in the pocket of the glove during storage and similar techniques, has failed to develop a method or system for effectively establishing and maintaining the best possible shape and structure of a glove.

SUMMARY OF THE INVENTION

A method of forming a mold for use with a baseball or softball glove comprising covering a substantial portion of the inner surface of the glove with a thin sheet of flexible material, applying a forming material to the flexible material such that the flexible material generally conforms to the shape of the inner surface of the glove, removing the hardened forming material from the glove, and removing the flexible material from the glove. In various exemplary embodiments the hardened forming material is the mold, or the hardened forming material is used to make one or more glove molds. In various exemplary embodiments, forming a cavity in the mold, wherein the cavity is configured to hold one or more objects.

A mold for use with a baseball or softball glove, comprising a firm material formed substantially into the shape of the inside surface of a baseball or softball glove, and a securing device to secure the mold in the glove when the glove is not in use. In various exemplary embodiments, the securing device comprises a strap or a bag that wraps around the outside of the glove to hold the mold in the glove, which may have a clip or loop to hang the glove with the mold in place. In various exemplary embodiments, the mold includes a recess in the surface of the mold for storage of an object, and features on the surface of the mold to allow airflow to the glove.

DETAILED DESCRIPTION OF THE PREFERRED EMBODIMENTS

The following description is presented to enable any person skilled in the art to make and use the invention. For purposes of explanation, specific nomenclature is set forth to provide a thorough understanding of the present invention. Descriptions of specific embodiments or applications are provided only as examples. Various modifications to the embodiments will be readily apparent to those skilled in the art, and general principles defined herein may be applied to other embodiments and applications without departing from the spirit and scope of the invention. Thus, the present invention is not intended to be limited to the embodiments shown, but is to be accorded the widest possible scope consistent with the principles and features disclosed herein.

Figure 1A:
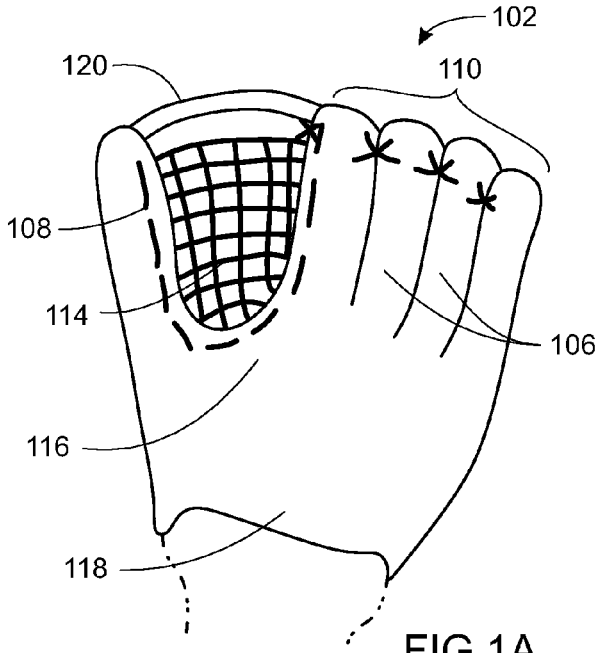
FIG. 1A is a diagram showing an exemplary infielder's glove in the open position.
Figure 1B:
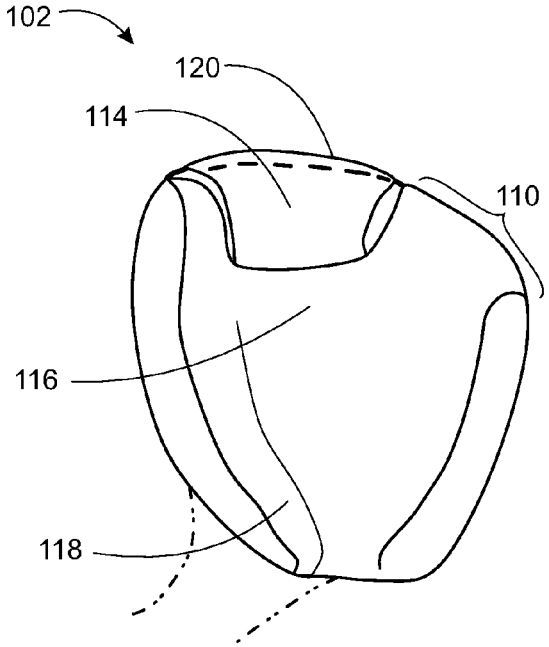
FIG. 1B is a diagram showing an exemplary catcher's glove in the open position.
Figure 1C:
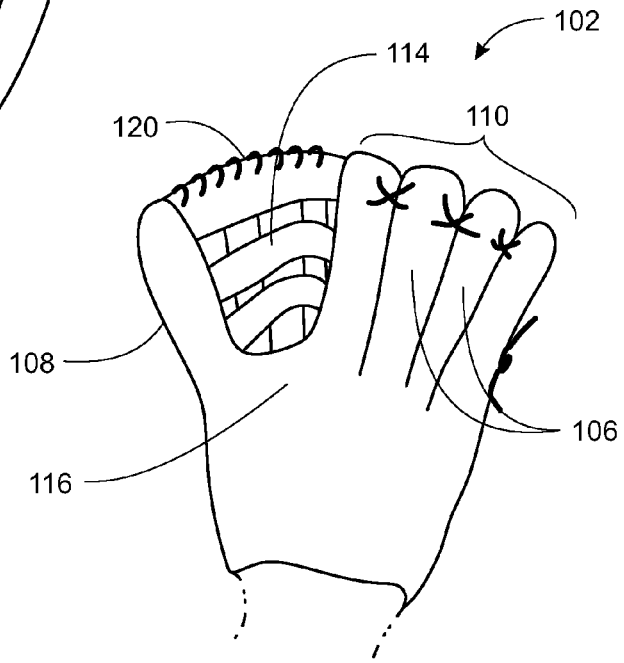
FIG. 1C is a diagram showing an exemplary outfielder's glove in the open position.
Figure 2A:
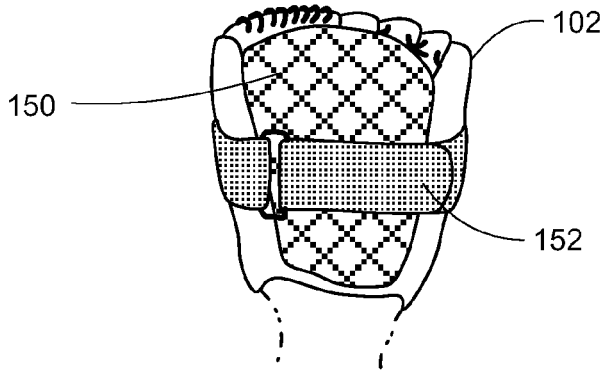
FIG. 2A is a diagram showing an exemplary infielder's glove with a mold held in place by a strap.
Figure 2B:
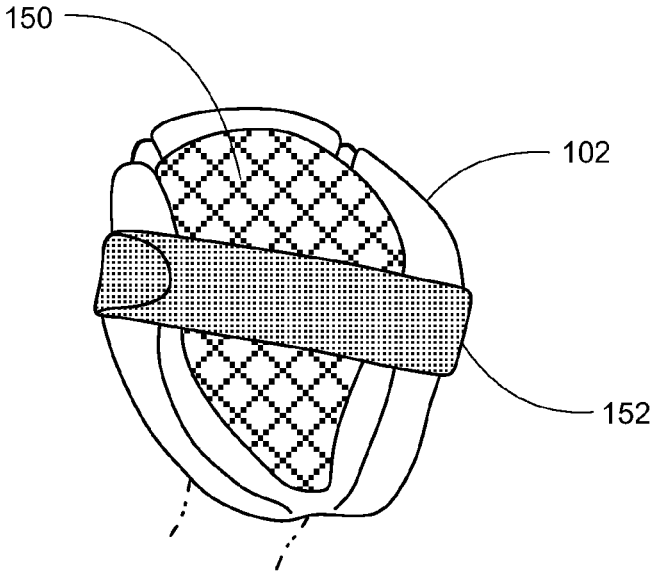
FIG. 2B is a diagram showing an exemplary catcher's glove with a mold held in place by a strap.
Figure 2C:
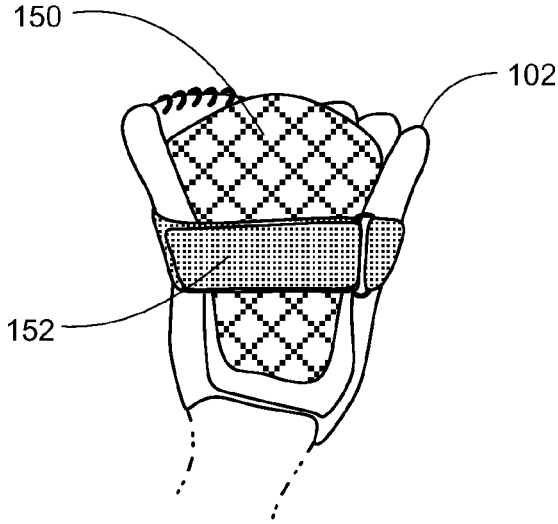
FIG. 2C is a diagram showing an exemplary outfielder's glove with a mold held in place by a strap.
Figure 3:
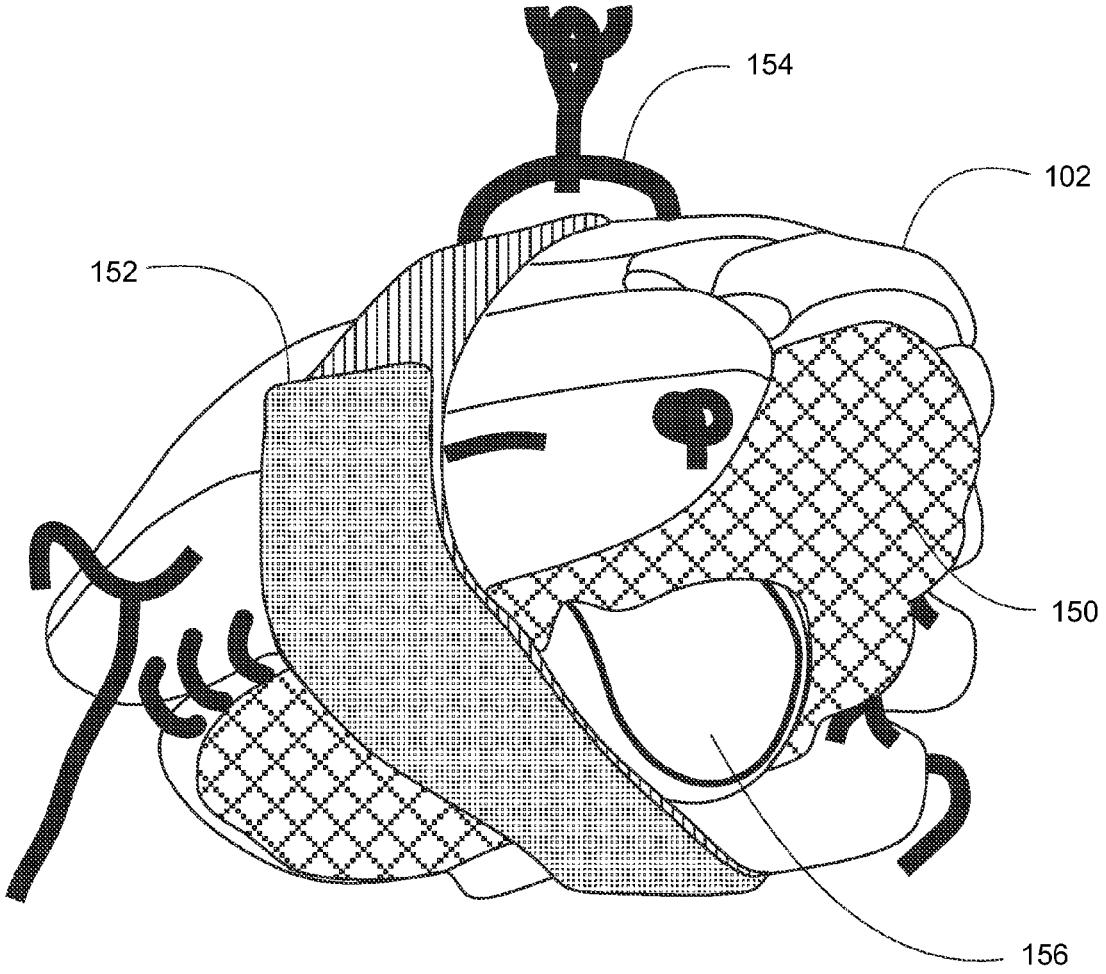
FIG. 3 is a diagram showing an exemplary embodiment of a mold in a glove, held in place with a strap.
Figure 4:
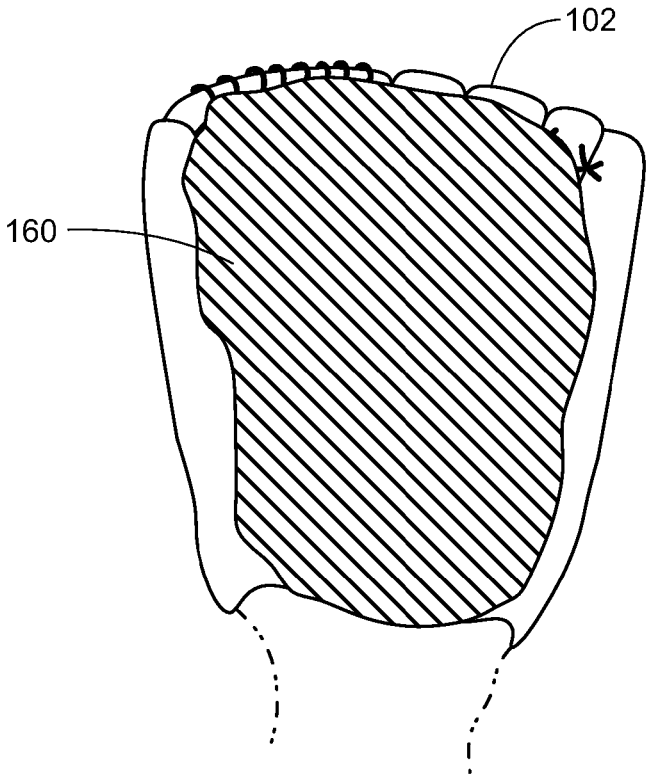
FIG. 4 is a diagram showing an exemplary glove with a sheet of flexible material draped over it prior to application of the forming material.
Figure 5:
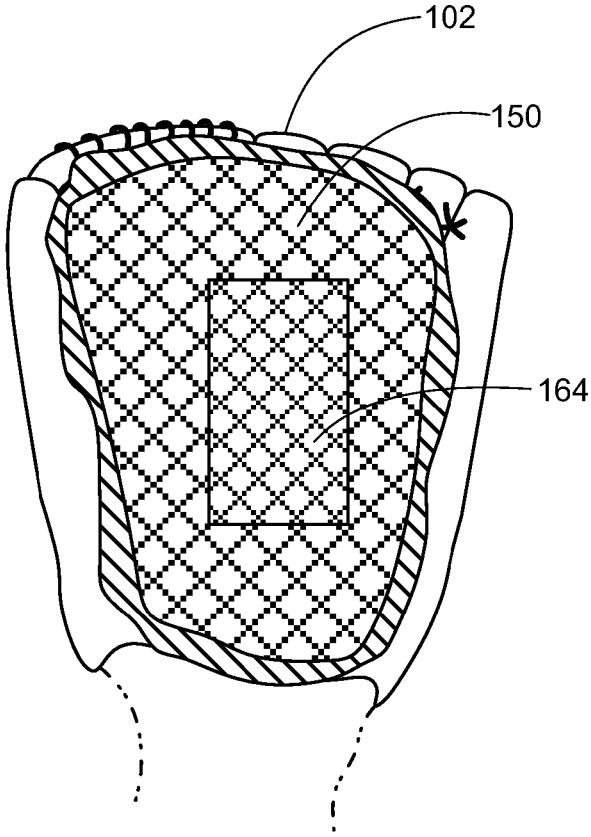
FIG. 5 is a diagram showing an exemplary glove with a sheet of flexible material draped over it after application of the forming material.

Referring to FIGS. 1A, 1B, and 1C, exemplary standard baseball gloves 102 are shown in an open position. The glove 102 shown in FIG. 1A is a typical infielder's glove, the glove 102 shown in FIG. 1B is a typical catcher's glove, and the glove 102 shown in FIG. 1C is a typical outfielder's glove. The gloves illustrated are exemplary only, the present invention can be used with any baseball or softball glove including those designed for use in the infield, outfield, and for catching.

All such gloves are placed over the user's fielding hand such that the fingers extend into individual finger slots 106 located on one side of the glove 102 and the thumb extends into a similar thumb slot 108 located on the other side of the glove 102 so that it can be moved in a direction opposed to the movement of the fingers to bring the glove 102 into a closed position. The finger slots 106 may be external as seen in FIGS.

1A and 1C, or internal as seen in FIG. 1B and as is common in catcher's and first base gloves. The finger slots 106 are generally interconnected to create a finger section 110 of the glove 102 that is relatively stiff and extends beyond the length of the fingers of the user to extend the reach of the user's hand. Similarly, the thumb slot 108 of the glove 102 typically extends beyond the length of the thumb and is relatively stiff to extend the reach of the user's hand.

A webbing area 114 generally extends between the finger section 110 in the area of the finger slot 106 that captures the index finger and the thumb slot 108. The lower portion of this webbing area 114 and the region of the glove 102 directly below it form what is generally referred to as the pocket 116 of the glove 102. It is generally desirable to have a well-formed pocket 116 that is slightly larger than the relevant ball used in the game.

A well-formed glove 102 has a shape when open that tends to funnel a ball impacting any part of the open glove 102 toward the pocket 106. This type of shape will be generally referred to herein as a "funnel" shape. The structure of such a glove 102 allows the areas around the pocket 106 to guide any balls that first impact the glove 102 on the finger section 110 or the thumb slot 108 or even the heel 118 or toe 120 of the glove 102 into the pocket 106 where the ball can be secured by squeezing the hand together. A glove 102 with a desirable funnel shape typically has a well-defined pocket 106 with a relatively stiff finger section 110 and thumb slot 108.

The glove 102 also preferably has an open slot in the heel 118 area that extends up to the pocket 106 that does not interfere with the fielder's throwing hand or forearm when accessing the ball in the glove 102. This open slot naturally guides the fielder's hand to the pocket 106 to retrieve the ball. Thus a well-formed glove 102 naturally rests in an open position that creates the largest receiving area for fielding a struck or thrown ball, provides an open slot to access the ball in the pocket 106, and is flexible along an axis extending generally from the base of the finger section 110 at the bottom or heel 118 of the glove up through the center of the pocket 116 to securely grasp the ball in the glove 102.

During use over time, a glove 102 is subjected to a wide range of conditions as it repeatedly heats up and cools down, becomes wet with perspiration and dries out, and is manipulated by the user, and stored between uses. Gloves are often stored in an equipment bag along with other items such as bats, helmets, and balls. These conditions tend to break down the structure of the glove 102 and make it less effective for secure capture of the ball and quick transfer to the throwing hand.

Referring to FIGS. 2A, 2B, 2C, and 3 in various exemplary embodiments of the invention, a mold 150 is placed in the glove 102 when it is not being used to maintain the structure of the glove and allow it to properly dry out. In various exemplary embodiments, the mold may be made from a range of different materials or combination of materials including without limitation various polymers such as plastic, elastomers such as synthetic and natural rubber compounds, plaster and plaster-like compounds, fiberglass, laminates, metal screens or meshes, or any other suitable material that can be formed into a mold shape.

Referring to FIGS. 2-5, in various exemplary embodiments, the mold 150 may be shaped to maintain the glove 102 in an open, partially open, or closed position while supporting and maintaining the pocket 106, finger section 110, and thumb slot 108 in their proper relative positions. In various exemplary embodiments, the mold is held in place by one or more straps 152 that extend around the glove 102 and mold 150, and may provide some compression force. Such straps 152 may be elastic or inelastic and formed from any suitable material, and may be separate from or integrated with the mold 150. In various exemplary embodiments, the strap 152 can be fastened and held in place by standard hook and loop fasteners, buckles, clips, or any suitable device. In various alternative embodiments, the mold 150 can be held in place by a variety of elastic or non-elastic structures and means, including bands, sleeves, bags, or any other structure that will maintain the mold 150 in the proper position within the glove 102 during storage and transport.

In various exemplary embodiments, the mold 150 and the strap(s) or other structure(s) that hold the mold 150 in the glove 102 may be designed with features that insure that the mold is properly aligned in the glove and/or that apply a moderate amount of pressure to the mold to secure it in the proper position. For example, a mold 150 may include one or more grooves, guides, loops, or other suitable structures to insure that attachment straps 152 are positioned correctly to hold the mold in the proper position and if desired apply pressure on the mold. Such designs should avoid applying pressure to the edges of the glove that would cause the glove to be deformed or damages.

Strap 152 or any other structure or means used to hold the mold 150 in the glove 102 may also be provided with one or more loops 154, rings, clips, or carabiners that can be used to attach the glove 102 and mold 150 to a wall, hook, bag, or other structure for storage or transport.

The mold 150 can be formed using any design and molding technique. In various exemplary embodiments, a mold 150 can be custom made to fit a particular player's glove 102 or to obtain a particular desired shape. In various exemplary embodiments, a player's glove may be covered in a thin sheet of flexible material 160 that extends over the inner surface of the glove 102 and can generally conform to the shape of the inner surface of the glove 102. The flexible material 160 may extend beyond the inner surface of the glove 102 and drape over the edges of the glove if desirable for the particular process and materials being used to form the mold. The flexible material 160 may be any suitable material that can conform to the shape of the glove, such as fabric, metal foils such as aluminum foil, or coated papers.

A suitable forming material such as plaster or any liquid or slurry that will take the shape of a vessel and harden can then be poured, placed, and/or pressed into the open glove 102 while it is held in the desired open, partially open, or closed position such that the forming material conforms to the shape of the inner surface of the glove 102. Once the forming material hardens, it can be removed from the glove 102 and if appropriate the flexible material 160 can be removed. The forming material can then be used directly as the mold 150 itself, or it can be used as a form to create one or more duplicate or similar molds 150. The result is a custom mold 150 that can be used to maintain the desired shape of the player's glove.

In various exemplary embodiments, a mold 150 can be created based on the shape of a popular player's glove 102 and potentially sold with the endorsement of the player. Complete lines of player endorsed or "pro model" molds may be created and sold for use with various types or models of gloves. The specific shape of the mold 150 may also be standardized for a particular make, model, or style of glove 102. Thus, rather than a custom mold built to maintain the form of the individual player's glove, such molds 150 can be used to create and maintain a particular or standardized glove shape. Since molds can be mass produced in a particular shape, the invention allows for mass production of a wide range of glove molds 150 that can be provided with a glove 102 at the time of sale, or sold separately at the time the glove is sold or as an aftermarket product.

It will also be readily understood by of those of ordinary skill in the art that a wide range of materials can be used for a glove mold 150. Moreover, the mold 150 can be constructed using any appropriate manufacturing technique, and may be solid, hollow, perforated, or otherwise designed to allow for airflow through the mold 150 to the inner surface of the glove 102. For example, the inner surface of the mold 150 may include air channels, or the mold may be made use a mesh or other material that allows airflow to reach the inner surface of the glove 102 so that it dries out between uses.

The mold 150 may also be formed with one or more recesses 164 or storage spaces to hold different items, such as a ball 156 or other equipment, playing cards, snacks or any other objects. Such recesses can be open as show in FIG. 3, or they may be fully enclosed to securely hold small items. In various exemplary embodiments, the mold may include a recess 164 that accepts various inserts to hold a range of different types of objects. For example, the mold may include a recess that has particular dimensions, and can be fitted with a small locking box, or an insert designed to hold specific items like a ball, wallet, dip can, glove oil, tools, a set of keys, mobile phone, etc. When using a molding process like that described above, such a recess can be established while the forming material is hardening by using a block of wood, metal or any suitable material to displace the forming material from the area of the recess.

What is claimed is:

1. A method of forming a mold for use with a baseball or softball glove comprising:

covering a substantial portion of the inner surface of the glove with a thin sheet of flexible material;

applying a forming material to the flexible material such that the flexible material generally conforms to the shape of the inner surface of the glove;

allowing the forming material to harden;

removing the hardened forming material from the glove; and removing the flexible material from the glove.

2. The method of claim 1, wherein the hardened forming material is the mold.

3. The method of claim 1, further comprising using the hardened forming material to make one or more glove molds.

4. The method of claim 3, further comprising forming a cavity in the mold, wherein the cavity is configured to hold one or more objects.

* * * * *